US005252260A

United States Patent [19]

Schuman

[11] Patent Number: 5,252,260

[45] Date of Patent: Oct. 12, 1993

[54] HUMIDIFIER ELECTRICAL CONTROL ASSEMBLY

[75] Inventor: Daniel C. Schuman, Oregon, Wis.

[73] Assignee: Research Products Corporation, Madison, Wis.

[21] Appl. No.: 882,891

[22] Filed: May 14, 1992

[51] Int. Cl.[5] ..... B01F 3/04

[52] U.S. Cl. ..... 261/26; 261/106; 126/113

[58] Field of Search ..... 261/26, 106; 126/113

[56] References Cited

U.S. PATENT DOCUMENTS

| | | | |
|---|---|---|---|
| 3,570,822 | 3/1971 | Peterson et al. | 261/106 |
| 4,158,679 | 6/1979 | Yeagle | 261/106 |
| 4,237,080 | 12/1980 | Elliott | 126/113 |
| 4,576,013 | 3/1986 | Sperr et al. | 261/26 |
| 5,015,420 | 5/1991 | Jones | 261/106 |
| 5,108,663 | 4/1992 | Chiu | 261/26 |
| 5,143,656 | 9/1992 | Marino et al. | 261/126 |

*Primary Examiner*—Tim Miles

*Attorney, Agent, or Firm*—Andrus, Sceales, Starke & Sawall

[57] ABSTRACT

An electrical control assembly for a humidistat controlled humidifier of the type having a base connected to the furnace ductwork and a cover removably connected to the base includes a control circuit board having a primary circuit for operation of the fan and a secondary circuit for operation of the humidistat and solenoid valve. A separable electrical connector disposed within the humidifier has a connected state in which power is supplied to the humidistat and a solenoid valve and a disconnected state in which power for the humidistat and solenoid valve is cut off. The electrical connector is fixedly mounted in the base and cover of the humidifier and is positioned so that the electrical connection is automatically made when the cover is connected to the base.

6 Claims, 2 Drawing Sheets

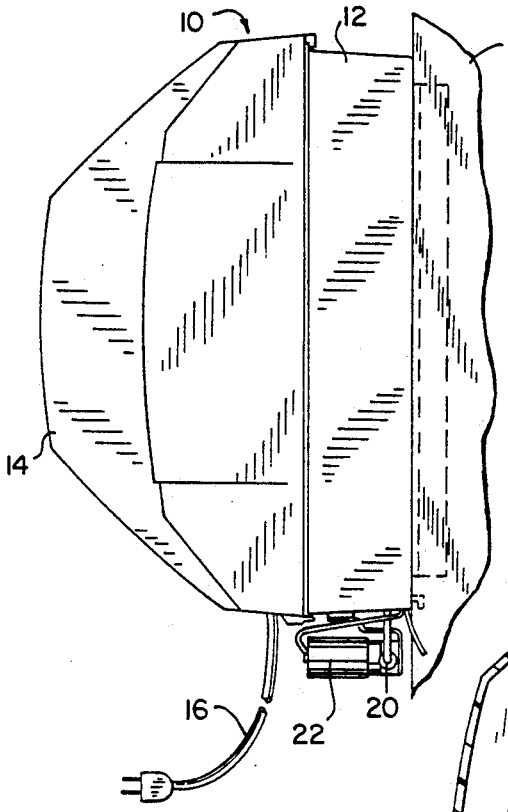
FIG. 1
FIG. 2
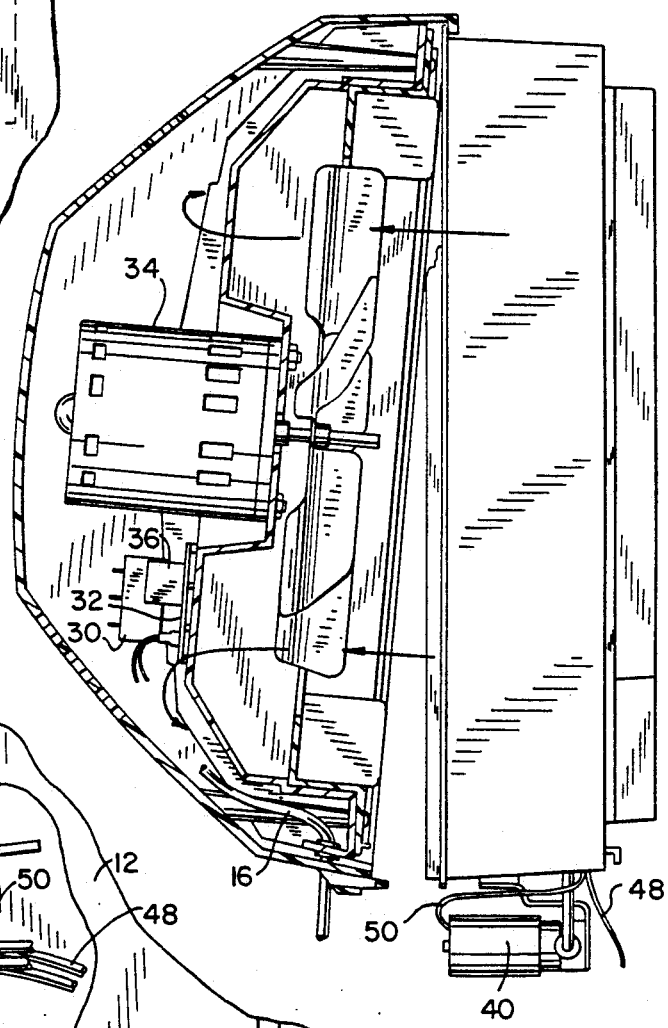
FIG. 3
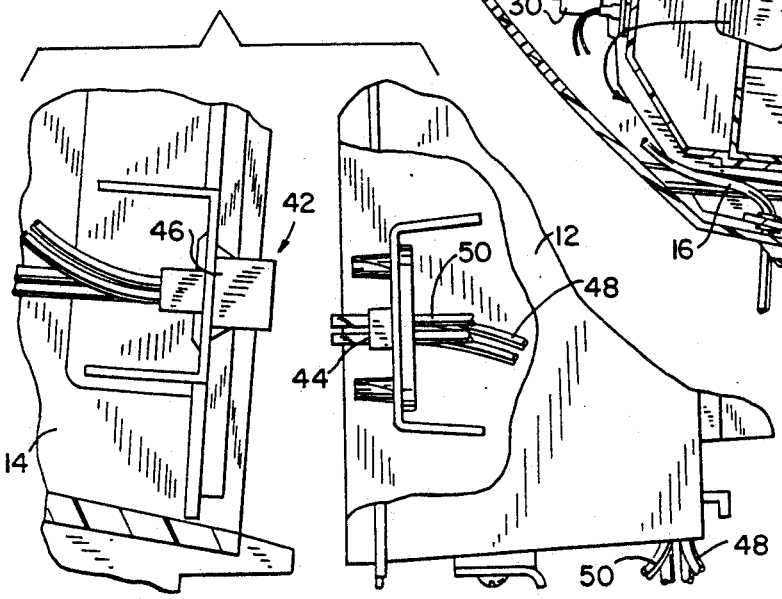

FIG. 4
PRIOR ART
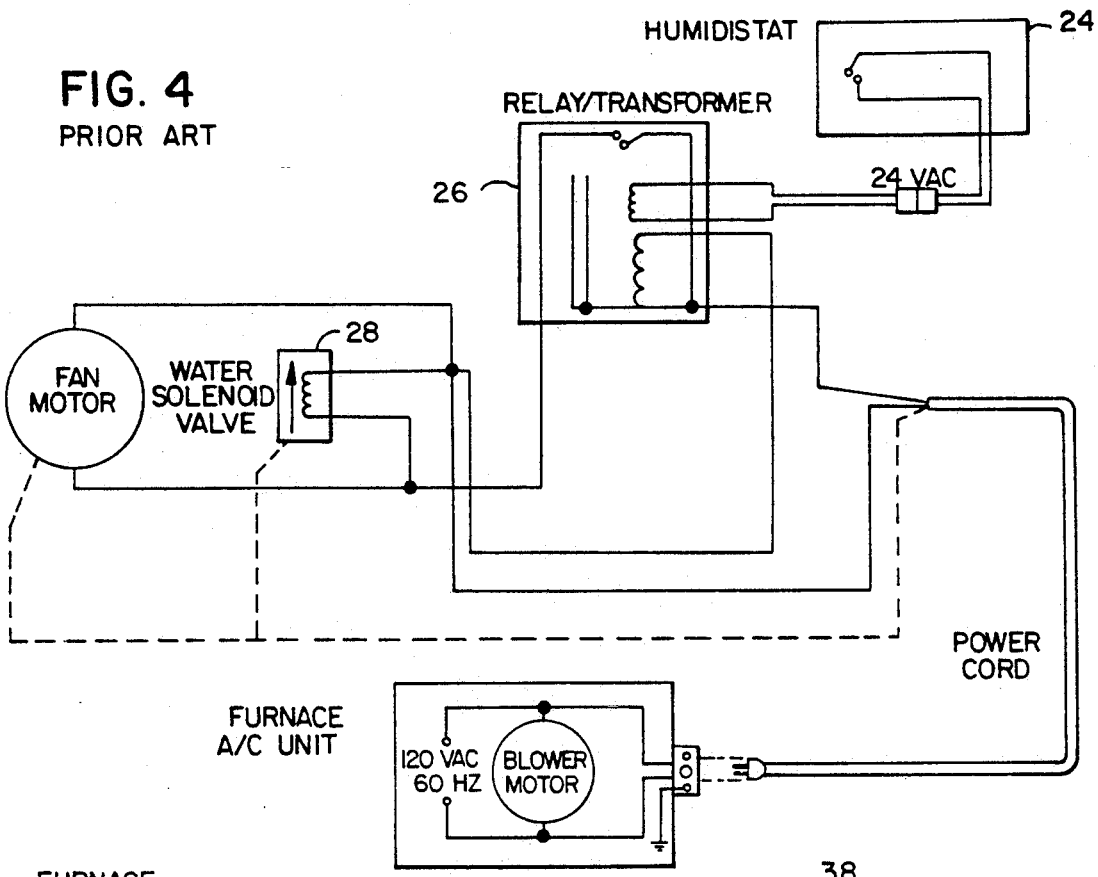
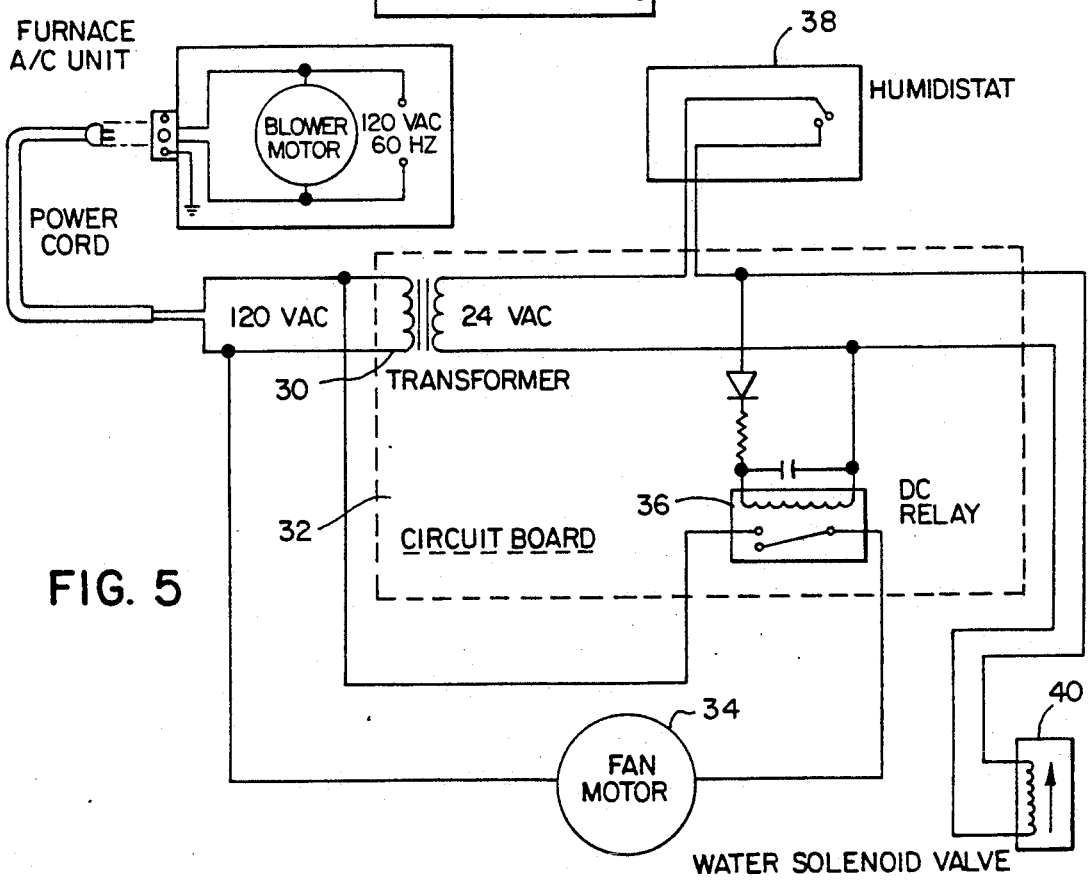
FIG. 5

HUMIDIFIER ELECTRICAL CONTROL ASSEMBLY

BACKGROUND OF THE INVENTION

The present invention relates to humidifiers and more specifically to the electrical control circuitry for the operation of a humidifier used in conjunction with a furnace. Humidifiers of this type typically utilize an electric motor to move air across a water-soaked evaporative pad. The humidifier is connected to the plenum of the furnace so that the humidifier air can be combined with the warm furnace air and distributed throughout the building.

These humidifiers generally use a transformer and an alternating current relay or a hybrid relay/transformer to operate the water solenoid valve and the fan motor. The 120 volt AC supply is interfaced with the furnace so power is present only when the furnace blower is operating. Typically, 120 volts of alternating current is supplied to a transformer with a low voltage output, usually 24 volts AC. The transformer or relay/transformer powers a secondary circuit which consists of a water solenoid valve and a humidistat in series. The humidistat switches to an on position when it senses a low moisture level in the air. When the furnace blower is on and the humidistat switch is closed, the fan motor for the humidifier is energized. Such a circuit is shown in FIG. 4.

Periodic maintenance of humidifiers of this type requires that the evaporative pad be changed. In the past, the entire humidifier was removed from the furnace plenum in order to obtain access to the evaporative pad. However, it is more desirable to be able to access the evaporative pad by merely removing a cover from the humidifier. To do this, it is necessary to have electrical components that are easily disconnected and reconnected.

It is an object of the present invention to provide a control circuitry for a humidifier that may be easily disconnected and reconnected during the periodic maintenance of the humidifier.

SUMMARY OF THE INVENTION

An electrical control assembly for a humidistat controlled humidifier of the type having a base connected to the furnace ductwork and a cover containing an electrically powdered fan includes a control circuit board mounted in the cover and having a primary circuit for operation of the fan and a secondary circuit for operation of the humidistat and solenoid valve of the humidifier.

In accordance with one aspect of the invention, the control assembly is provided with a separable electrical connector disposed within the humidifier and having a connected state in which power is supplied to the humidistat and the solenoid valve and a disconnected state in which power for the humidistat and solenoid valve is cut off.

In accordance with yet another aspect of the invention, the separable electrical connector is in the form of a male and female connector, one of which is fixedly attached to the cover and the other of which is fixedly connected to the base.

In accordance with still another aspect of the invention, the male and female connectors are positioned so as to align and connect when the cover of the humidifier is connected to the base.

The present invention thus provides an electrical control assembly which may be readily used with a humidifier having a cover removably connected to a base. The assembly allows the electrical connector to be easily separated when the cover is removed from the base and to be easily re-connected when the cover is re-attached to the base.

BRIEF DESCRIPTION OF THE DRAWINGS

The drawings illustrate the best method presently contemplated of carrying out the invention.

In the drawings:

FIG. 1 is a side view of a humidifier of the type utilizing the electrical control assembly of the present invention;

FIG. 2 is a side cross-sectional view of the humidifier of FIG. 1;

FIG. 3 is an enlarged cross-sectional view of the electrical connection between the cover and the base of the humidifier;

FIG. 4 is a schematic of the electrical circuitry utilized in prior art humidifiers; and FIG. 5 is a schematic of the electrical circuitry utilized in the present invention.

DETAILED DESCRIPTION OF THE INVENTION

As seen in FIG. 1, a humidifier 10 includes a base portion 12 and a cover 14. A power cord 16 is connected through the bottom of cover 14 and provides 120 volt AC power. Base portion 12 is connected to the warm air plenum 18 of a furnace system. Base portion 12 includes an evaporative pad (not shown) and a water feed tube 20 which supplies water to a distribution tray (not shown) for the pad. One end of feed tube 20 is connected to solenoid valve 22 which controls the flow of water through the feed tube. The operation of solenoid valve 22 is controlled by a humidistat 38.

FIG. 4 illustrates a typical prior art electrical circuit for use in a humidifier of this type. In this circuit, 120 volts AC is supplied to a relay/transformer 26 which powers a secondary circuit consisting of water solenoid valve 28 and humidistat 24. The fan motor is interfaced with the furnace so power is present only when the furnace blower motor is on.

FIG. 5 illustrates the circuitry utilized in the electrical control assembly of the present invention. In this circuitry, transformer 30 is mounted on circuit board 32. The circuit board provides power for a primary circuit which operates fan motor 34 through circuit board mounted relay 36. The circuit board also provides power through a secondary circuit for operation of humidistat 38 and serially connected solenoid valve 40.

The electrical connection between circuit board 32 and humidistat 38 and solenoid valve 40 is accomplished by means of a separable electrical connector 42 having a male connector 44 fixedly connected in base 12 and a female connector 46 fixedly connected in cover 14. The electrical connector 42 contains leads 48 for connection to humidistat 38 and leads 50 for connection to solenoid valve 40. Male and female connectors 44 and 46 are positioned so that they align and connect when cover 14 is connected to base 12. Similarly, when cover 14 is removed from base 12, electrical connector 42 will separate. When electrical connection 42 is separated, humidistat 38 and solenoid valve 40 remain serially connected, but no power can be provided from circuit board 32. Similarly, when connector 42 is in its disconnected state, fan motor 34 remains serially connected to circuit board 32, but it cannot operate due to the fact that power has been cut off to humidistat 38.

The present invention thus provides an electrical control assembly that is easily and safely disconnected so as to allow for the removal of the cover of the humidifier.

Various modes of carrying out the invention are contemplated as being within the scope of the following claims particularly pointing out and distinctly claiming the subject matter regarded as the invention.

I claim:

1. An electrical control assembly for a humidistat controlled humidifier of the type having a base connected to the furnace ductwork and in which is housed an evaporative pad and a water feed tube to supply water to a distribution tray for the pad with one end of the feed tube connected to a solenoid valve that controls the flow of water and a cover removably connected to the base and in which is housed an electrically powered fan, said control assembly comprising:

a control circuit board mounted in the cover and having a primary circuit for operation of the fan and a secondary circuit for operation of the humidistat and solenoid valve, means for providing electrical power to said circuit board and a separable electrical connector disposed within the humidifier and having a connected state in which power is supplied to the humidistat and the solenoid valve and a disconnected state in which power to the humidistat and solenoid valve is cut off.

2. The electrical control assembly defined in claim 1 wherein said electrical connector is in said connected position when the cover is connected to the base and in said disconnected position when the cover is removed from the base.

3. The electrical control assembly defined in claim 1 wherein the humidistat and the solenoid valve remain serially connected when said electrical connector is in said disconnected state.

4. The electrical control assembly defined in claim 1 wherein said fan remains serially connected to said circuit board when said electrical connector is in said disconnected state.

5. The electrical control assembly defined in claim 1 wherein said electrical connector comprises a male and female connector with the male portion disposed in one of either the base or the cover and the female portion disposed in the other.

6. The electrical control assembly defined in claim 5 wherein said male and female connectors are fixedly attached in the base and cover and positioned so as to align and connect when the cover is connected to the base.

* * * * *